US006170233B1

(12) United States Patent
Marois et al.

(10) Patent No.: US 6,170,233 B1
(45) Date of Patent: Jan. 9, 2001

(54) WRAPPING MACHINE FOR WRAPPING AN ARTICLE FROM A ROLL OF FILM, AND A METHOD THEREOF

(75) Inventors: Yanick Marois; Patrick Masse, both of Ascot Corner (CA)

(73) Assignee: Wulftec International Inc., Quebec (CA)

( * ) Notice: Under 35 U.S.C. 154(b), the term of this patent shall be extended for 0 days.

(21) Appl. No.: 09/337,372

(22) Filed: Jun. 21, 1999

(30) Foreign Application Priority Data

Nov. 6, 1998 (CA) ..... 2251407

(51) Int. Cl.[7] ..... B65B 13/04
(52) U.S. Cl. ..... 53/399; 53/588
(58) Field of Search ..... 53/588, 210, 465, 53/399

(56) References Cited

U.S. PATENT DOCUMENTS

| | | | |
|---|---|---|---|
| 4,299,076 | 11/1981 | Humphrey | 53/587 |
| 4,631,898 | 12/1986 | Brambilla | 53/399 |
| 4,691,497 | 9/1987 | Lancaster | 53/399 |
| 4,831,812 | 5/1989 | Martin Cocher et al. | 53/399 |
| 5,005,335 | 4/1991 | Yourgalite et al. | 53/399 |
| 5,054,263 | 10/1991 | Mäki-Rahkola et al. | 53/399 |
| 5,107,657 | 4/1992 | Diehl et al. | 53/141 |
| 5,168,691 | 12/1992 | Errani | 53/587 |
| 5,301,493 | 4/1994 | Chen | 53/556 |
| 5,408,808 | 4/1995 | Masuda et al. | 53/556 |
| 5,423,163 | 6/1995 | Wendt | 53/556 |
| 5,450,709 | 9/1995 | Steding | 53/465 |
| 5,452,566 * | 9/1995 | Benhamou et al. | 53/588 |
| 5,517,807 * | 5/1996 | Morantz | 53/588 |
| 5,606,849 | 3/1997 | Bettenhausen | 53/556 |
| 5,623,808 | 4/1997 | Franklin et al. | 53/399 |
| 5,628,167 | 5/1997 | Huson et al. | 53/465 |
| 5,701,722 | 12/1997 | Franklin et al. | 53/399 |
| 5,787,691 | 8/1998 | Turfan et al. | 53/588 |
| 5,794,418 | 8/1998 | Lai | 53/556 |
| 5,802,810 | 9/1998 | Wojcik et al. | 53/399 |
| 5,836,140 | 11/1998 | Lancaster, III | 53/399 |

FOREIGN PATENT DOCUMENTS

| | | | |
|---|---|---|---|
| 177413 * | 4/1986 | (EP) | 53/588 |

* cited by examiner

*Primary Examiner*—Linda Johnson
(74) *Attorney, Agent, or Firm*—Myers Bigel Sibley & Sajovec, P.A.

(57) ABSTRACT

The wrapping machine is for wrapping an article from a roll of film. It comprises a film tail treatment device, a device moving mechanism for moving vertically the film tail treatment device, a device height detector for detecting the height of the film tail treatment device, a clamping mechanism for clamping a portion of the film unrolled from the roll, a clamp moving mechanism for moving vertically the clamping mechanism, a clamp height detector for detecting the height of the clamping mechanism, and a controller for controlling the carriage moving mechanism, the device moving mechanism and the clamp moving mechanism during the wrapping cycle with respect to the heights detected by the carriage, device and clamp height detectors. At the end of the wrapping cycle, the clamp mechanism is positioned at the height required to clamp the portion of the film during operation of the film tail treatment device.

19 Claims, 10 Drawing Sheets

WRAPPING MACHINE FOR WRAPPING AN ARTICLE FROM A ROLL OF FILM, AND A METHOD THEREOF

FIELD OF THE INVENTION

The present invention is concerned with a wrapping machine for wrapping an article from a roll of film, and a method thereof.

BACKGROUND OF THE INVENTION

Known in the art, there is the U.S. Pat. No. 5,107,657 of Werner K. DIEHL et al., granted on Apr. 28, 1992. In this patent, there is described an apparatus for wrapping a pallet load with a wrapping film applied selectively as a film rope or as a film sheet. A rotary arm support above the load B is arranged to be rotatably driven. A carriage which is mounted to an upright member, is arranged to be selectively driven along the upright member, either in an upward direction or in a downward direction.

Also known in the art, there is the U.S. Pat. No. 5,802,810 of John P. WOJCIK et al., granted on Sep. 8, 1998. In this patent, there is described a method and an apparatus for wrapping and securing film about a load. The film dispenser mounted on a rotary arm starts and stops the wrapping at a home lowered position.

Also known in the art, there is the U.S. Pat. No. 5,450,709 of Kurt L. STEDING, granted on Sep. 19, 1995. In this patent there is described a fully automatic stationary wrapping device having improved griping and cutting mechanisms. The device comprises a swing arm having a rotational circular motion and a swing arm carriage mounted and vertically displaced along a swing arm carriage support. With both circumferential and vertical displacement of the swing arm carriage, a helical wrapping pattern is produced on the stacked pallet. The wrapping starts with the swing arm carriage at its home position and ends with the swing arm carriage at the same home position. Then, the film is cut by melting.

Also known in the art, there is the U.S. Pat. No. 5,787,691 of Faruk M. TURFAN et al., granted on Aug. 4, 1998. In this patent, there is described an apparatus for wrapping articles in film material including a stationary frame supporting a vertically reciprocable frame which in turn supports a rotatable ring member carrying a film carriage assembly by which film is wrapped around a load during rotation of the ring member. The film carriage assembly is mounted on the ring member by means of a mounting bracket and, accordingly, is rotatable and vertically displaceable therewith.

Also known in the art, there are the following U.S. patents which describe different apparatuses and methods for wrapping articles:

U.S. Pat. No. 5,836,140 WRAPPING A LOAD WHILE CONTROLLING WRAP TENSION;

U.S. Pat. No. 5,802,810 METHOD AND APPARATUS FOR WRAPPING AND SECURING STRECH FILM ABOUT A LOAD;

U.S. Pat. No. 5,787,691 APPARATUS FOR WRAPPING ARTICLES IN PLASTIC FILM;

U.S. Pat. No. 5,794,418 PALLET STRETCH WRAPPING MACHINE;

U.S. Pat. No. 5,701,722 APPARATUS AND METHOD FOR PALLETIZING AND WRAPPING A LOAD;

U.S. Pat. No. 5,628,167 METHOD AND APPARATUS FOR WRAPPING ELONGATE LOAD HAVING GENERALLY CIRCULAR OR GENERALLY ANNULAR ENDS;

U.S. Pat. No. 5,623,808 APPARATUS AND METHOD FOR PALLETIZING AND WRAPPING A LOAD;

U.S. Pat. No. 5,606,849 APPARATUS FOR WRAPPING A PACKAGE;

U.S. Pat. No. 5,450,709 STATIONARY PALLET STRECH WRAPPING DEVICE HAVING IMPROVED METHOD AND APPARATUS FOR GRIPPING AND CUTTING OR WRAPPING FILM;

U.S. Pat. No. 5,423,163 FREE STANDING PALLET WRAPPING APPARATUS;

U.S. Pat. No. 5,408,808 AUTOMATIC FULL-WEB STRETCH-WRAPPING APPARATUS;

U.S. Pat. No. 5,301,493 STEPLESSLY ADJUSTABLE PRE-STRETCHED FILM WRAPPING APPARATUS;

U.S. Pat. No. 5,168,691 AUTOMATIC PLASTIC FILM WRAPPING MACHINE PARTICULARLY SUITABLE FOR SUITCASE;

U.S. Pat. No. 5,107,657 WRAPPING APPARATUS AND RELATED WRAPPING METHODS;

U.S. Pat. No. 5,054,263 METHOD AND APPARATUS FOR WRAPPING A PLASTIC FILM AROUND A LOAD;

U.S. Pat. No. 5,005,335 STRETCH WRAPPING ROBOTIC PALLETIZER;

U.S. Pat. No. 4,831,812 PROCESS AND APPRATUS FOR PASS-THROUGH WRAPPING;

U.S. Pat. No. 4,691,497 FILM LAMINATION STRETCH WRAPPING;

U.S. Pat. No. 4,631,898 PROCESS AND APPARATUS FOR CONTINUOUS WRAPPING OF PALLETIZED LOAD;

U.S. Pat. No. 4,299,076 WRAPPING APPARATUS AND METHOD.

The drawback with all of the above-mentioned patents is that automatic machines have to wrap from bottom of the load to the top thereof, and then go back to the bottom to end its wrapping cycle. In that way, two layers of film are used to wrap the load. This results in a waste of film since sometimes only one layer of film in needed. This is also a time consuming operation since time is spent to wrap the second layer of film.

It is an objet of the present invention to provide a method and a wrapping machine that allows to start a wrapping cycle at any location along the load, and stop the wrapping operation also at any location along the load.

It is also an object of the present invention to provide a method and an wrapping machine for wrapping an article where it is possible to wrap the article with a single layer of film.

It is also an object of the present invention to provide a wrapping machine and a method to wrap an article where the wrapping of the article is faster than the method and apparatus of the prior art.

SUMMARY OF THE INVENTION

According to the present invention, there is provided a wrapping machine for wrapping an article from a roll of film, comprising:

a machine frame having a wrapping area where the article is received;

a film delivering carriage onto which the roll of film is rotatively mountable;

carriage moving means for moving the film delivering carriage vertically and horizontally around the article, the carriage moving means being mounted on the machine frame;

a carriage height detector for detecting the height of the film delivering carriage;

a film tail treatment device comprising cutting means for cutting the film;

device moving means for moving vertically the film tail treatment device at a desired height with respect to the article;

a device height detector for detecting the height of the film tail treatment device;

clamping means for clamping a portion of the film unrolled from the roll, in proximity of the article;

clamp moving means for moving vertically the clamping means at a desired height with respect to the article;

a clamp height detector for detecting the height of the clamping means; and controlling means for controlling the carriage moving means, the device moving means and the clamp moving means during the wrapping cycle with respect to the heights detected by the carriage, device and clamp height detectors so that, at the end of the wrapping cycle, the clamp means is positioned at the height required to clamp said portion of the film during operation of the film tail treatment device.

Also according to the present invention, there is provided a method for wrapping an article from a roll of film, comprising following steps:

a) placing the article within a wrapping area;

b) clamping a free end of the roll of film with clamping means nearby the article, the roll of film being rotatively mounted on a film delivering carriage;

c) moving the film delivering carriage vertically and horizontally around the article for wrapping said article;

d) after a predetermined period of time from the beginning of step (c), commanding the clamping means to release the free end of the roll of film;

e) during step (c), detecting the height of the film delivering carriage in order to control the moving of step (c) in respect to a predetermined sequence of wrapping;

f) stopping step (c) at the end of the predetermined sequence of wrapping;

g) moving vertically a film tail treatment device;

h) during step (g) detecting the height of the film tail treatment device;

i) stopping step (g) when step (h) detects that the film tail treatment device is at a desired height with respect to a film portion extending between the roll of film and the article;

j) after step f, moving vertically the clamping means;

k) during step (j) detecting the height of the clamping means;

l) stopping step (j) when step (k) detects that the clamping means is at a desired height with respect to said film portion;

m) after step (l), clamping said film portion with the clamping means; and n) after step (m), cutting said film portion with cutting means of the film tail treatment device.

DETAILED DESCRIPTION OF THE DRAWINGS

Figure 1:
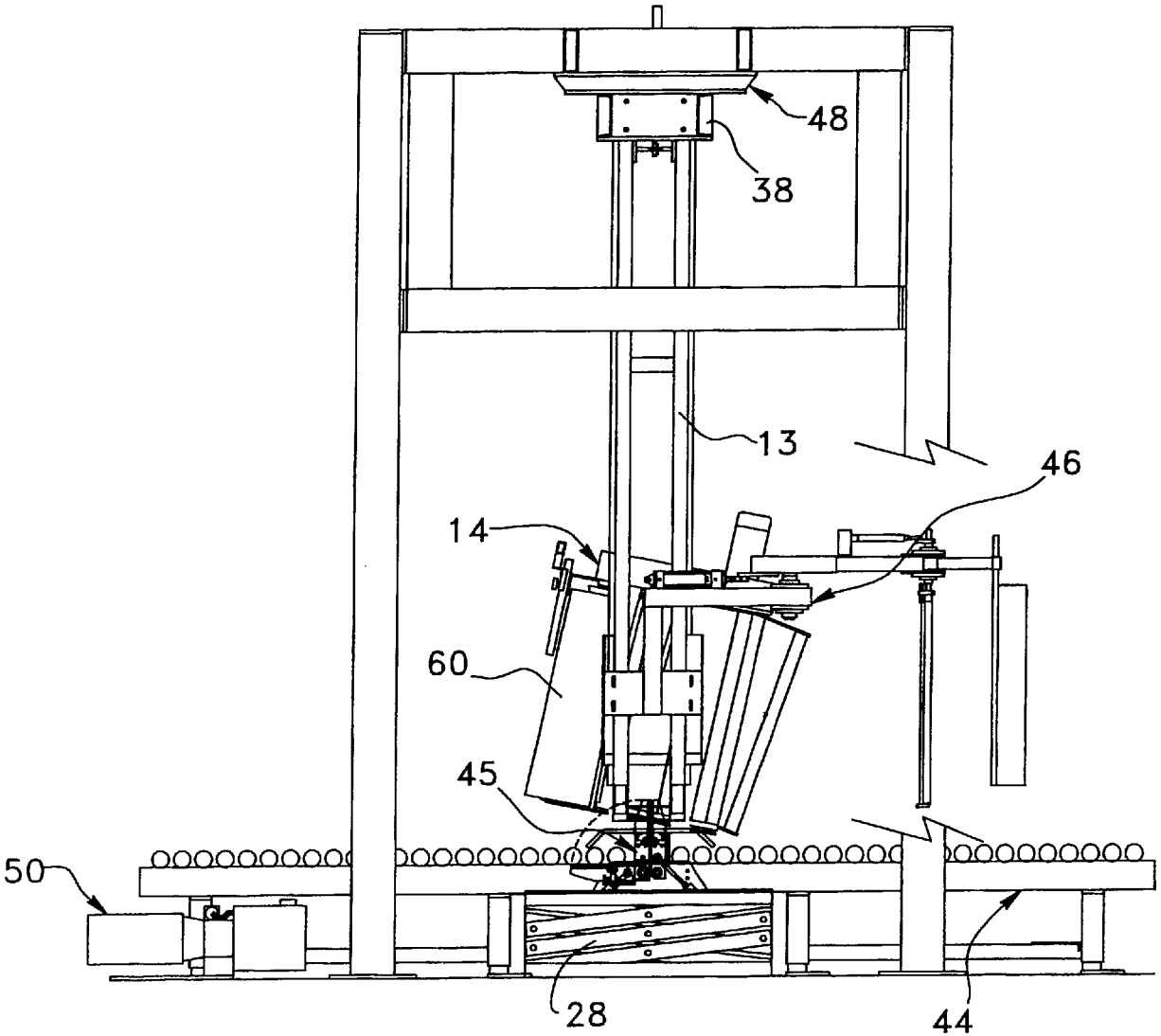
FIG. 1 is a front view of a wrapping machine according to the present invention.
Figure 2:
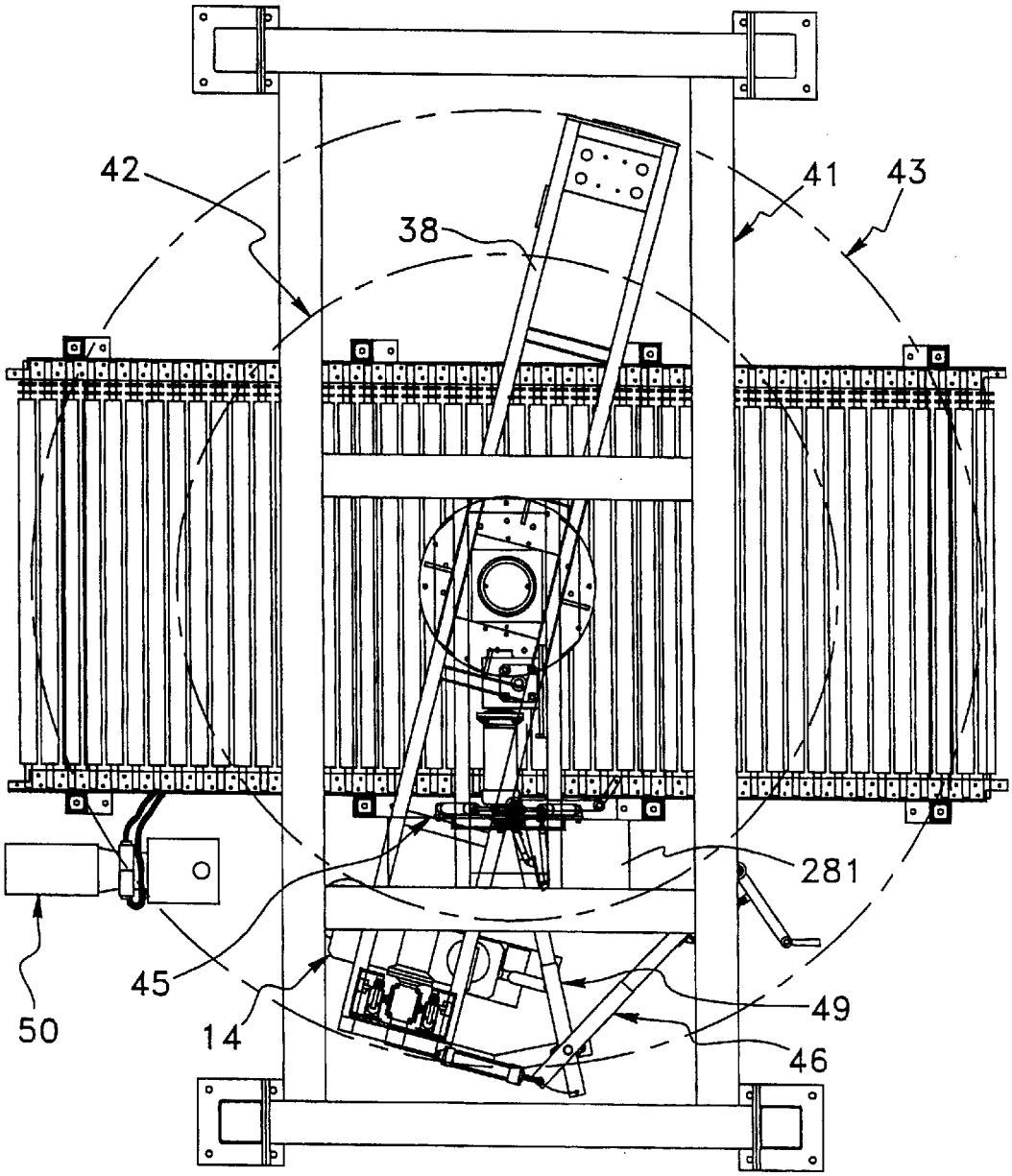
FIG. 2 is a top view of the wrapping machine shown in FIG. 1.
Figure 3:
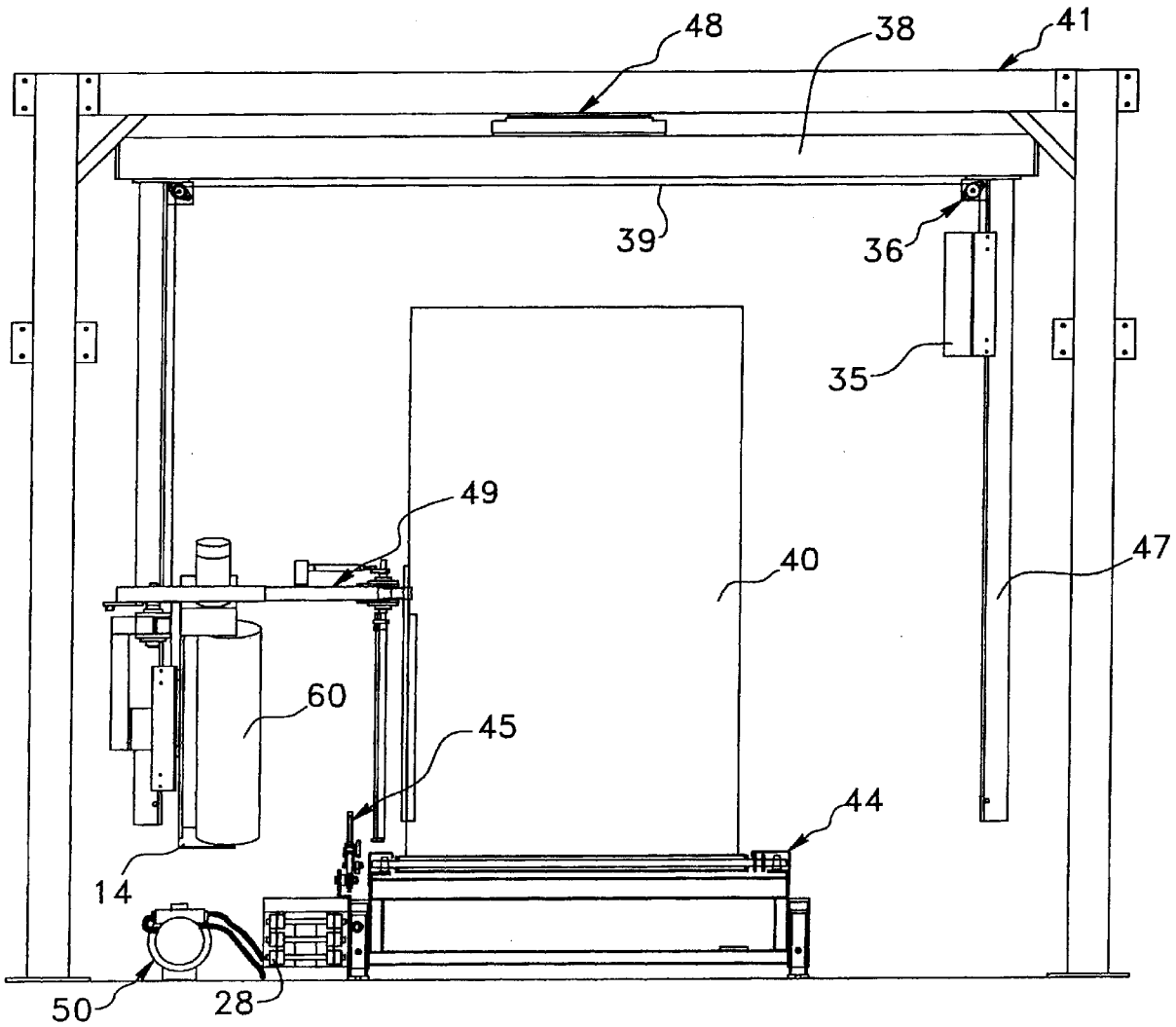
FIG. 3 is a side elevation view of the wrapping machine shown in FIG. 1.

Referring to FIGS. 1, 2 and 3, the wrapping machine for wrapping an article (40) from a roll of film (60), comprises a machine frame (41) having a wrapping area where the article (40) is received. A conveyor 44 is preferably used for placing the article (40) in the wrapping area. The term "article" corresponds to any kind of object which is desirable to be wrapped. The wrapping area is confined into the wrap diameter (42). The wrapping machine further comprises a film delivering carriage (14) onto which the roll of film (60) is rotatively mountable, and a carriage moving mechanism for moving the film delivering carriage (14) vertically and horizontally around the article (40). The carriage moving mechanism will described below in relation to FIGS. 1 to 4. The outside diameter (43) represents the outer limit where the film delivering carriage (14) rotates. The carriage moving mechanism is mounted on the machine frame (41) and will be more discussed below with respect of FIGS. 3 and 4.

The wrapping machine further comprises a film tail treatment device (102) which comprises a cutting mechanism for cutting the film (60) and will be described below. However, it can be appreciate that the film tail treatment device (102) may move between an operating position (49) where it can be in operation, and a standby position (46) where it is resting. The film tail treatment device (102) is shown in a standby position (46) in FIG. 1, in an operating position (49) in FIG. 3, and in both positions (46, 49) in FIG. 2. The wrapping machine also comprises a device moving mechanism for moving vertically the film tail treatment device (102) at a desired height with respect to the article (40), and a device height detector for detecting the height of the film tail treatment device (102). The device moving mechanism and the device height detector will be discussed below with respect of FIGS. 4 and 5.

The wrapping machine also further comprises a clamping mechanism (45) for clamping a portion of the film (60) unrolled from the roll, in proximity of the article (40). The clamping mechanism (45) will be discussed with respect of FIGS. 9, 10 and 11. The wrapping machine comprises also a clamp moving mechanism for moving vertically the clamping mechanism (45) at a desired height with respect to the article (40) and a clamp height detector for detecting the height of the clamping mechanism. The clamp moving mechanism and the clamp height detector will be more discussed below with respect of FIGS. 6, 7 and 8.

Referring now to FIGS. 1, 2, 3 and 4, the carriage moving mechanism preferably comprises a vertical carriage boom (13) along which the film delivering carriage (14) is slidably mounted. Preferably, the carriage (14) is mounted on the boom (13) with two carriage mounting brackets (15) shown in FIG. 4. Sliders (16) (shown in the top view of FIG. 5) are fixed to the brackets (15) to allow an up and down movement of the carriage (14) along the boom (13). The carriage moving mechanism also comprises a horizontal rotary arm (38) having a centre, a first end and a second end. The centre of the rotary arm (38) is pivotally mounted to an upper portion of the machine frame (41) above the wrapping area where the article (40) is placed. This can be achieved by a ring gear (48). The first end of the rotary arm (38) rigidly supports an upper end of the carriage boom (13).

Figure 4:
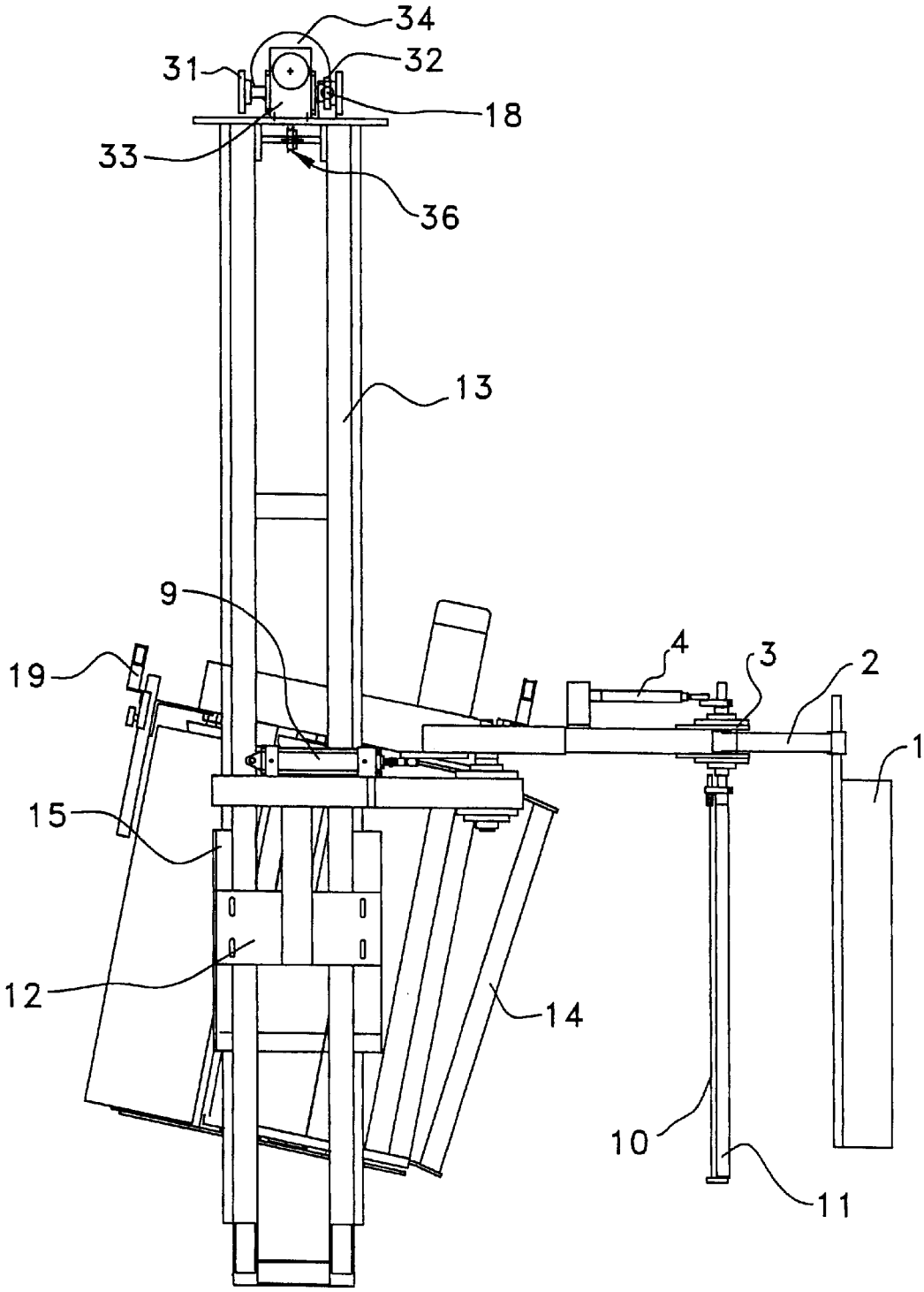
FIG. 4 is a front view of a part of the wrapping machine shown in FIGS. 1 to 3.
Figure 5:
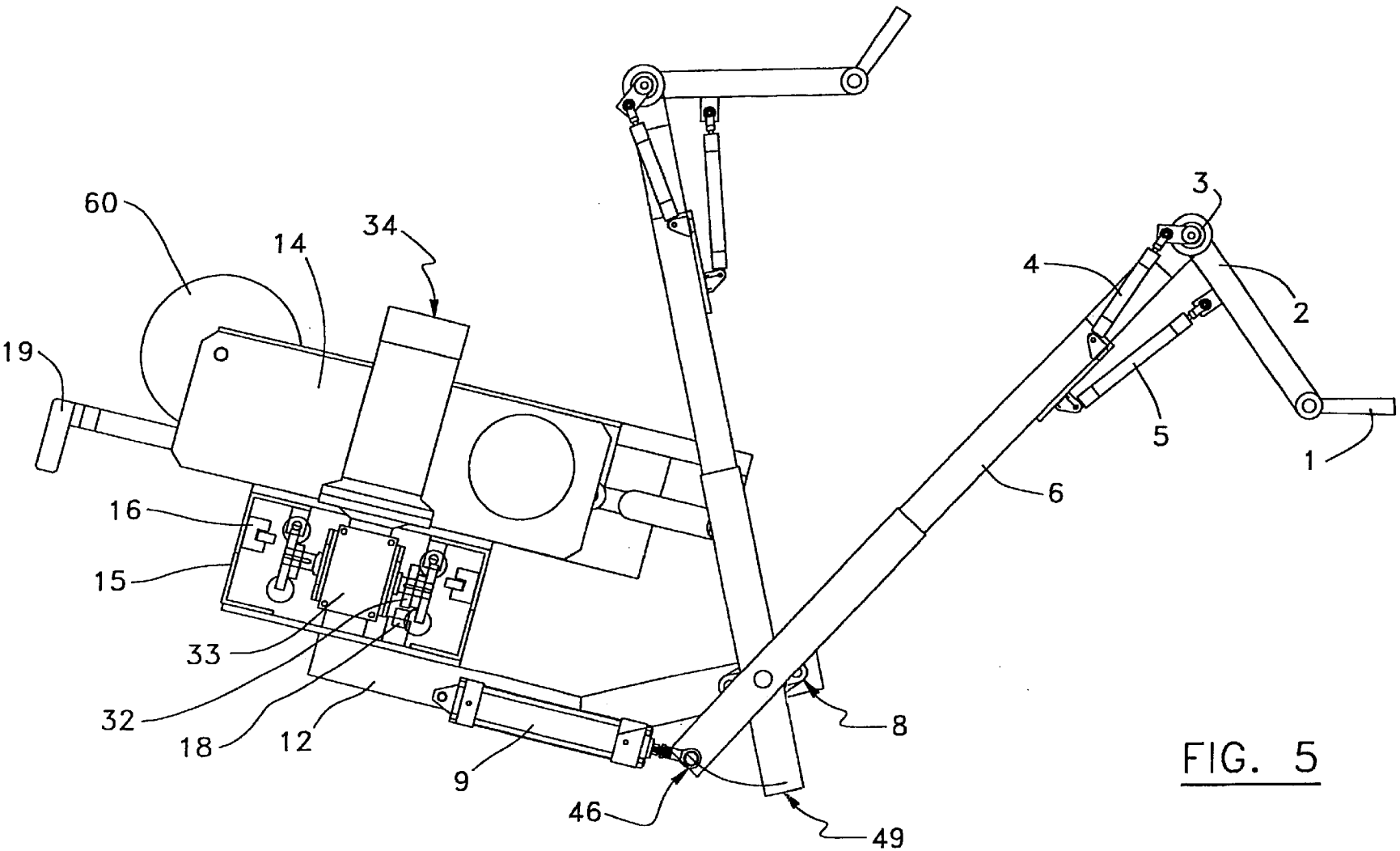
FIG. 5 is a top view of the part of the wrapping machine shown in FIG. 4.

Referring now to FIGS. 3, 4 and 5, the carriage moving mechanism preferably comprises a counterweight boom (47) having an upper end rigidly supported by the second end of the rotary arm (38), and a counterweight (35) slidably mounted on the counterweight boom. It also comprises a cable (39) which interconnects the counterweight (35) and the film delivering carriage (14). The cable (39) is guided by two idler sheaves (36, 36') mounted respectively at both ends of the rotary arm (38). The carriage moving mechanism also comprises a carriage motor (34) for driving the film delivering carriage (14) along the carriage boom (13).

Figure 13:
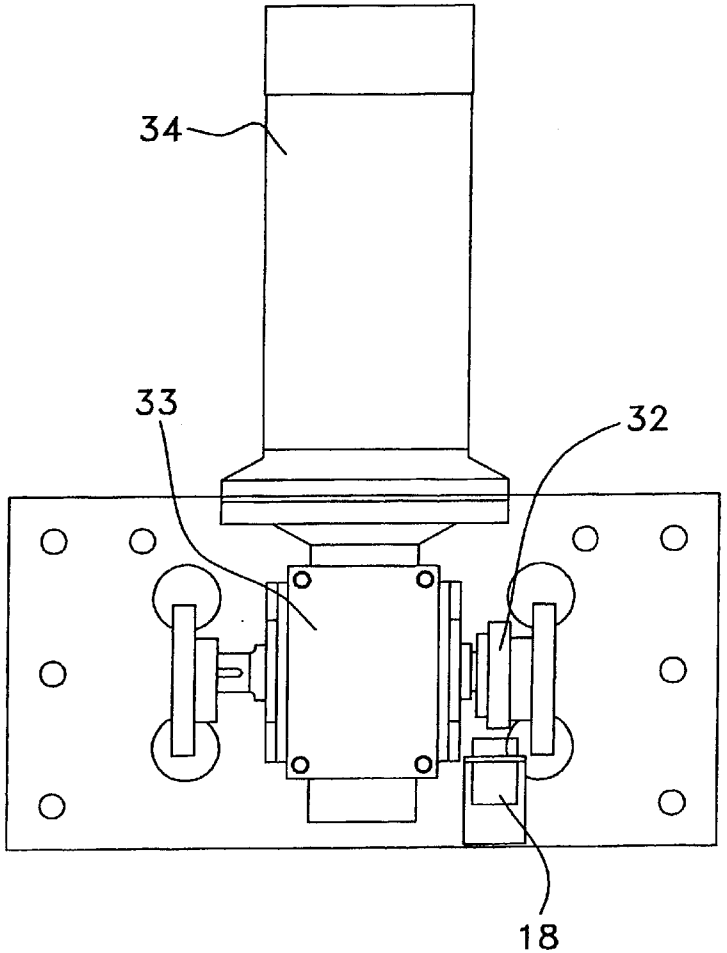
FIG. 13 is a top view of the detail shown in FIG. 12.
Figure 12:
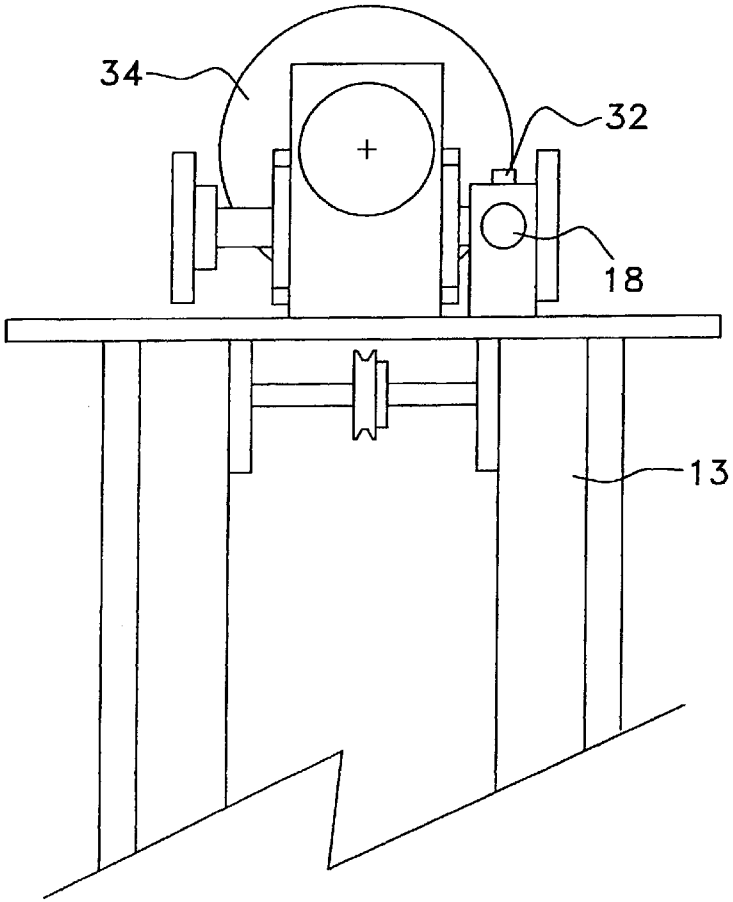
FIG. 12 is enlarged view of a detail of FIG. 4.

Referring more particularly to FIGS. 12 and 13, the wrapping machine further comprises a carriage height detector for detecting the height of the film delivering carriage (14). The carriage height detector preferably 20 comprises a count sprocket (32) driven by the carriage motor (34). Advantageously, the carriage motor (34) drives the film delivering carriage (14) and the count sprocket (32) through a single transmission (33) in such a way that the count sprocket (32) rotates in correlation with the vertical motion of the film delivering carriage (14). Therefor, the rotation of the count sprocket (32) is a witness for the height of the film delivering carriage (14) and is used for detecting such. The carriage height detector further comprises a proximity sensor (18) mounted in proximity of the count sprocket (32) for counting the rotation of the count sprocket (32).

In a preferred embodiment of the invention, the reference height of the carriage (14) is the lower position on the boom (13), as it is going up or down, the proximity sensor (18) counts the number of tooth on the count sprocket (32). According to the count sprocket size, each tooth on the count sprocket (32) could mean that the carriage (14) moves up or down one inch.

Referring to FIGS. 4 and 5, and according to a preferred embodiment of the invention, the film tail treatment device (102) is mounted on the film delivering carriage (14) by means of a device mounting bracket (12). More particularly, the device mounting brackets (12) are mounted on the carriage mounting brackets (15) as shown in FIG. 4. Therefor, the device moving mechanism is provided by the carriage moving mechanism above-described in relation to FIGS. 3, 4 and 5, and the device height detector is provided by the carriage height detector above-described in relation to FIGS. 12 and 13.

For moving from a standby position (46) to an operating position (49) and vice versa, the film tail treatment device (102) preferably comprises a telescopic arm (6) having a first end, a second end, and a portion pivotally mounted on the mounting bracket (12). The film tail treatment device (102) also comprises a pivot bearing (3) for pivotally mounting the cutting mechanism on the second end of the telescopic arm (6), and a device actuator (9) interconnecting the device mounting bracket (12) and the first end of the 30 telescopic arm (6) in order to pivot the telescopic arm (6) between the operating position (49) where, in operation, the cutting mechanism is properly located to cut the film (60), and the standby position (46) where the movement of the film delivering carriage (14) around the article (40) to wrap said article (40) is allowed. The telescopic arm (6) is pivotally mounted with a bearing assembly (8).

Still referring to FIGS. 4 and 5, the cutting mechanism preferably comprises a support (103) mounted on the pivot bearing (3). The cutting mechanism further comprises an elongated insulator (11) and a vertical heat wire (10) which are mounted on the support (103) in parallel relation. The cutting mechanism also comprises a rotating mechanism for rotating the support (103) about the pivot bearing (3). The rotating mechanism includes a cut actuator (4) interconnecting the second end of the telescopic arm (6) and the support (103).

Referring again to FIGS. 4 and 5, the film tail treatment device (102) preferably comprises wiping mechanism for wiping a free end of the film (60) against the article (40), the free end of the film (60) being generated by the earlier action of the cutting mechanism at the end of a wrapping cycle. The wiping mechanism comprises a brush (1) and a brush arm (2). The brush arm (2) has a first end pivotally mounted on the second end of the telescopic arm (6), the brush (1) being mounted along the length of the brush arm (2). The wiping mechanism further comprises a pivoting mechanism for pivoting the brush arm (2) with respect to the telescopic arm (6) so that, in operation, the brush (1) wipes the free end of the film against the article (40) at the end of the wrapping cycle. The pivoting mechanism includes a brush actuator (5) interconnecting the second end of the telescopic arm (6) and the brush arm (2).

Figure 10:
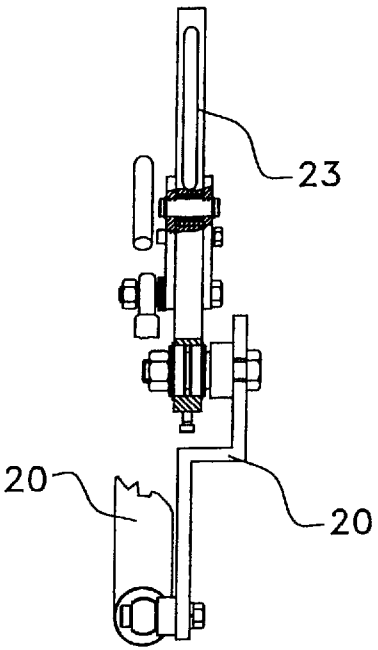
FIG. 10 is a side elevation view of the element shown in FIG. 9.
Figure 11:
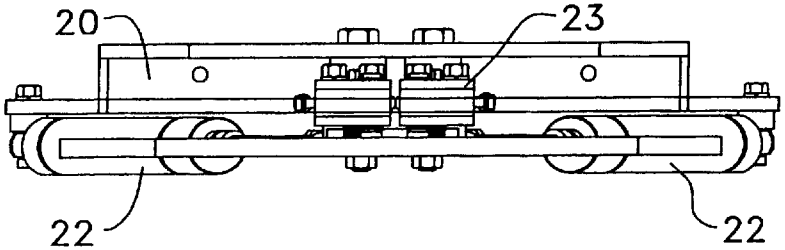
FIG. 11 is a top view of the element shown in FIGS. 9 and 10.
Figure 9:
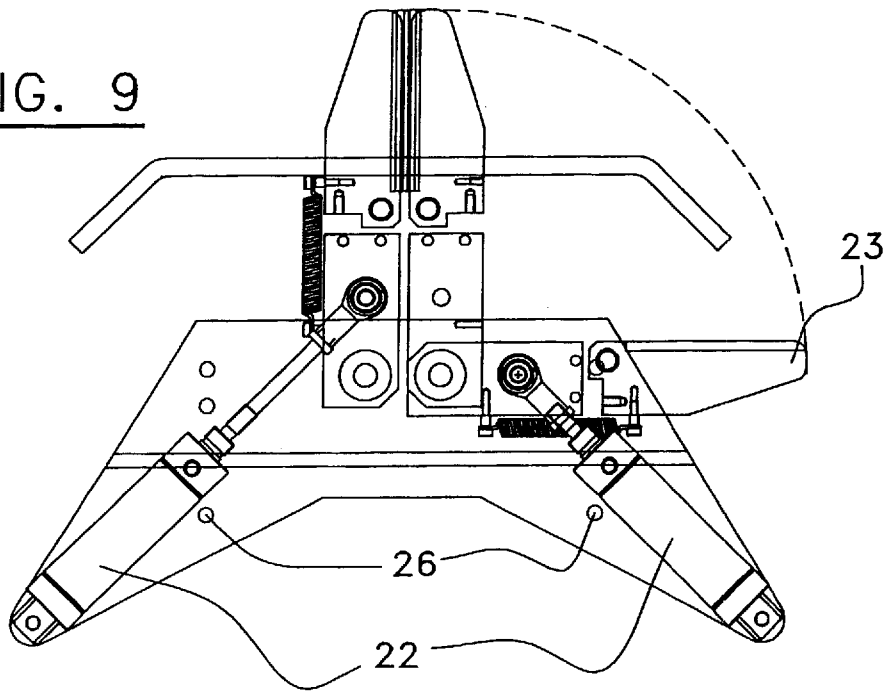
FIG. 9 is an enlarged view of an element shown in FIG. 6.

Referring now to FIGS. 9, 10 and 11, the clamping mechanism (45) (shown in FIGS. 1, 2 and 3) preferably comprises a pair of jaws (23), a mounting plate (20) on which each jaw (23) is pivotally mounted, and a pair of jaw actuators (22) for actuating respectively the jaws (23). Each jaw actuator (22) interconnects the mounting plate (20) and the corresponding jaw (23) in order to pivot the corresponding jaw (23) between an opened position and a closed position.

Figure 7:
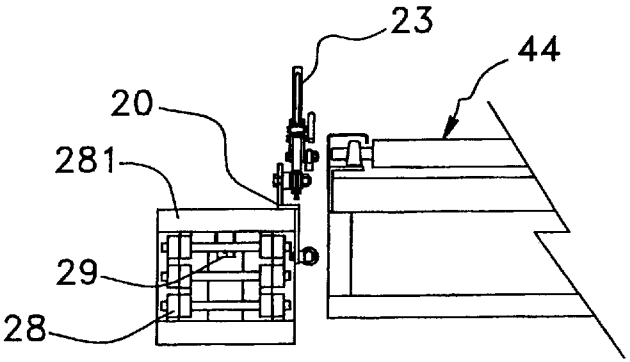
FIG. 7 is a side elevation view of the part shown in FIG. 6.
Figure 8:
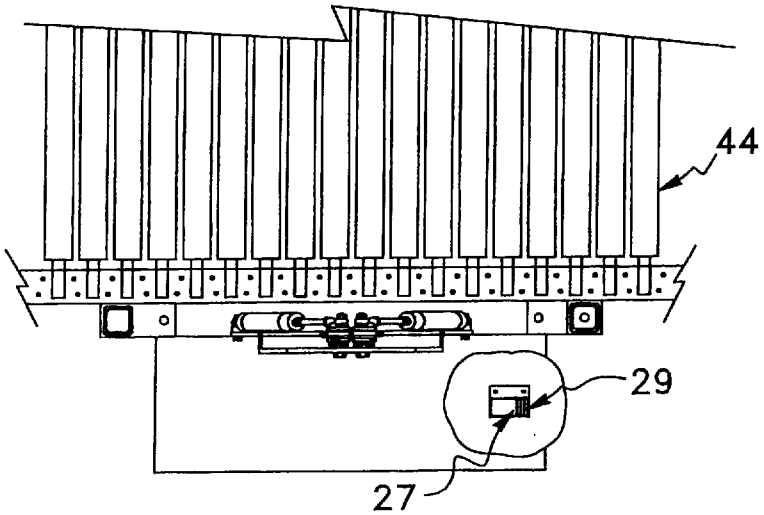
FIG. 8 is a top view of the part shown in FIGS. 6 and 7.
Figure 6:
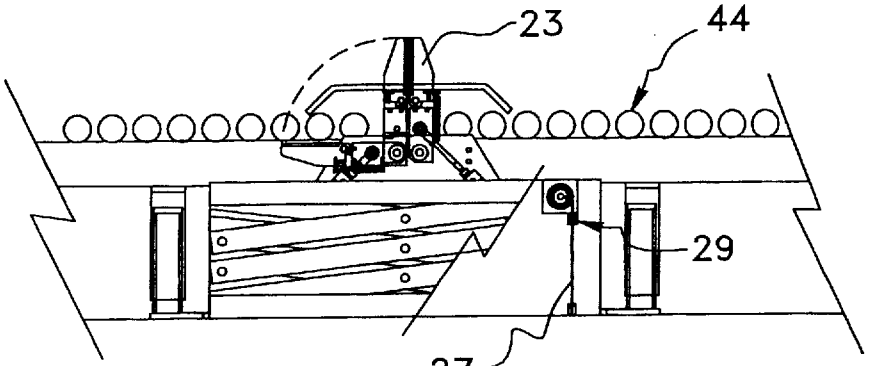
FIG. 6 is an enlarged view of a part of the wrapping machine shown in FIG. 1.

Referring now to FIGS. 6, 7 and 8, the clamp moving mechanism preferably comprises a scissors lift (28) having a mobile end movable between a standby position and an elevated position. The mobile end of the scissors lift (28) has a table (281) onto which the mounting plate (20) of the clamping mechanism (45) is mounted. Preferably, the mounting plate (20) is bolted to the table (281) via the mounting holes (26) (shown in FIG. 9). The mounting plate (20) is advantageously located at the centre of the table (281) of the scissors lift (28). The table (281) is located as close as possible to the wrapping area or the conveyor (44) if a conveyor is used.

Figure 14:
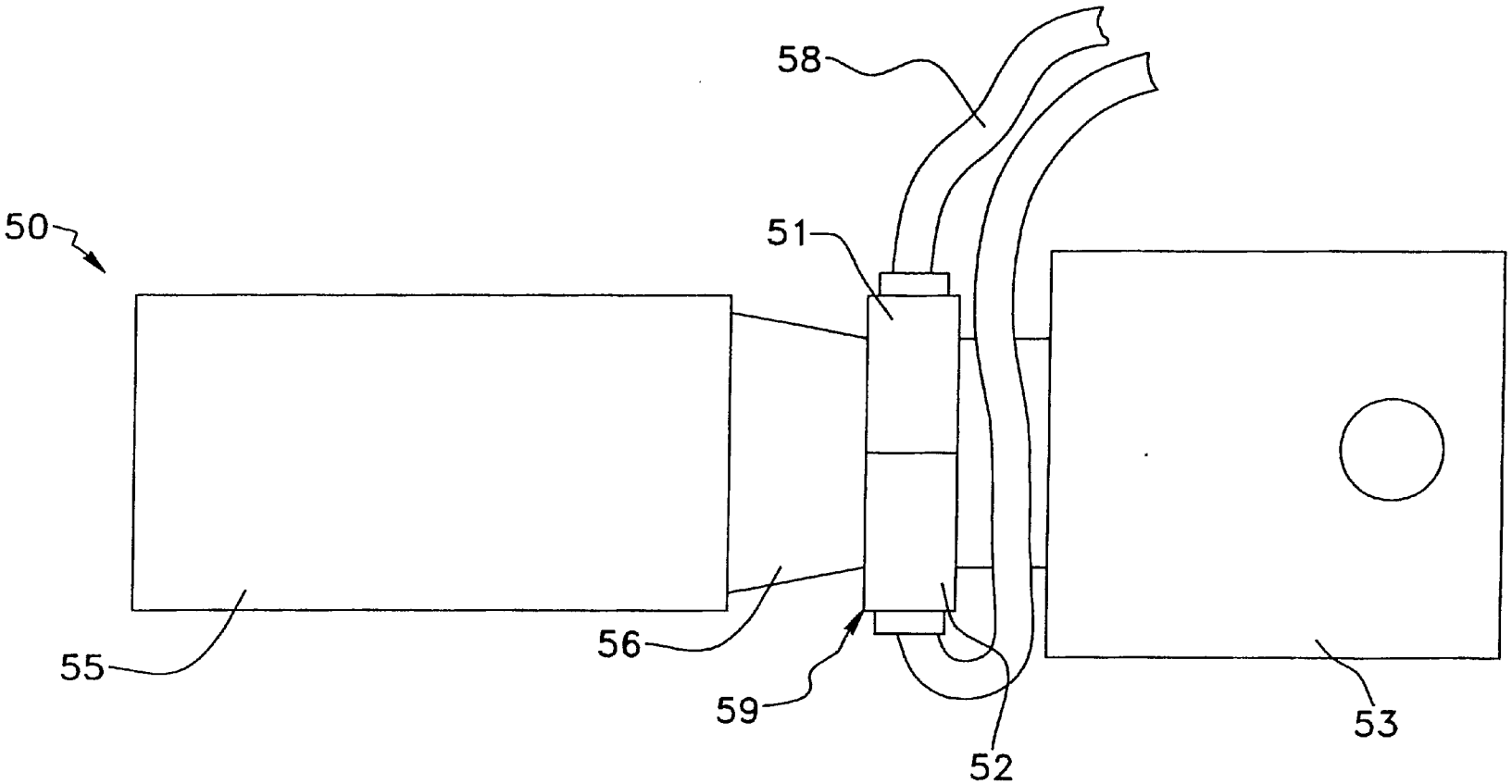
FIG. 14 is an enlarged view of a detail of FIG. 2.

As shown in FIGS. 1, 2 and 3, and in detail in FIG. 14, the clamp moving mechanism preferably comprises an hydraulic unit (50) for moving the mobile end of the scissors lift (28). The hydraulic unit (50) comprises a motor (55), an hydraulic pump (56) driven by the motor (55), an oil tank

(53) connected to the hydraulic pump (56), an hydraulic circuit (58) connected to the hydraulic pump (56) and to the oil tank (53), and a valve (59) connected to the hydraulic circuit (59). The valve (59) comprises an elevating command solenoid (51) and a lowering command solenoid (52). The elevating command solenoid (51) is used for commanding an elevation motion to the scissors lift (28). The lowering command solenoid (52) for commanding an lowering motion to the scissors lift (28).

Referring again to FIGS. 6, 7 and 8, the clamp height detector preferably comprises a roll strip (27) having a portion moving in relation to a displacement of the mobile end of the scissors lift (28). The strip (27) is provided with regularly spaced apart holes (not shown). The clamp height detector further comprises a emitting/receiving optical mechanism for emitting light toward said portion of the strip (27), and for receiving light reflection therefrom to count passing holes of the strip (27). The emitting/receiving optical mechanism consist in a photoeye emitter/receiver (29).

According to a preferred embodiment of the invention, every hole in the strip (27) means that the table (281) moved up or down one inch. As soon as the carriage (14) starts moving towards one direction the scissors lift (28) moves the table (281) where the set of jaws (23) are mounted towards that same direction. The scissors lift (28) is stopped when it matches the distance travelled by the carriage (14). For example, when the carriage (14) moves up thirty inches, the scissors lift (28) moves up thirty inches.

Referring now to FIG. 4, the wrapping machine further comprises an optical proximity sensing mechanism (19) mounted on the film delivering carriage (14) for detecting presence of the article (40) as the film delivering carriage (14) is moving along the vertical boom (13). According to a wrapping cycle, the carriage (14) stop going up when the optical proximity sensing mechanism (19) detects the top of the article (40).

Figure 15:
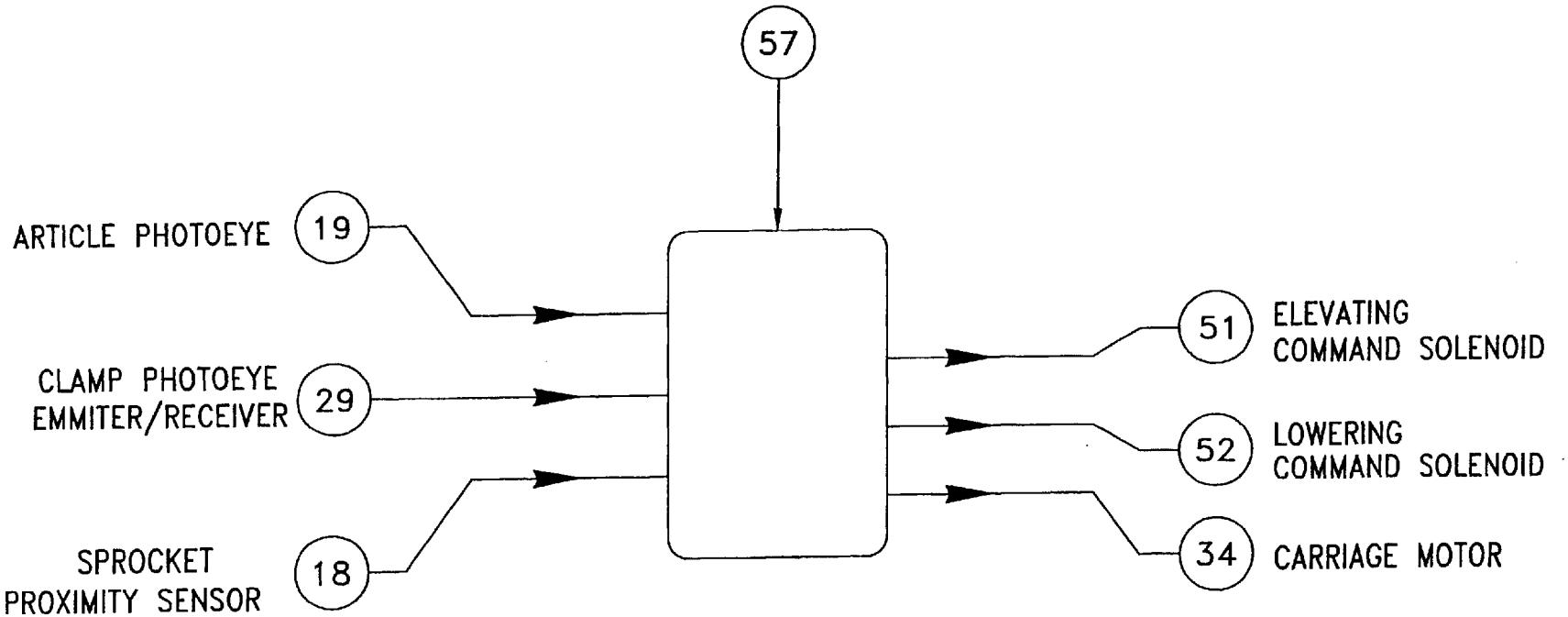
FIG. 15 is a schematic representation of the inputs and outputs of the controller.

Referring to FIG. 15, the wrapping machine further comprises a controlling mechanism (57). The controlling mechanism (57) is used to control the carriage moving mechanism, the device moving mechanism and the clamp moving mechanism during the wrapping cycle with respect to the heights detected by the carriage, device and clamp height detectors so that, at the end of the wrapping cycle, the clamp mechanism is positioned at the height required to clamp said portion of the film (60) which is unrolled from the roll and in proximity of the article (40), during operation of the film tail treatment device (102).

The controlling mechanism (57) has output to generate command signals for the carriage motor (55) of the carriage moving mechanism; the elevating command solenoid (51) solenoid of the clamp moving mechanism; and the lowering command solenoid (52) of the clamp moving mechanism. The controlling mechanism (57) has also input to receive output signals from the proximity sensor (18) of the carriage height detector; the emitting/receiving optical mechanism (photoeye emitter/receiver (29) or the like) of the clamp height detector; and the optical proximity sensing mechanism (19) mounted on the film delivering carriage (14) so that, in operation, the controlling mechanism is informed of where is located the top end of the article.

Referring generally to all of the figures, it is now described a method for wrapping an article (40) from a roll of film (60) according to the present invention. The figures show the elements that are referred to in the following description. The method comprises following steps:

a) placing the article (40) within a wrapping area;

b) clamping a free end of the roll of film (60) with clamping mechanism nearby the article (40), the roll of film (60) being rotatively mounted on a film delivering carriage (14);

c) moving the film delivering carriage (14) vertically and horizontally around the article (40) for wrapping said article (40);

d) after a predetermined period of time from the beginning of step (c), commanding the clamping mechanism to release the free end of the roll of film;

e) during step (c), detecting the height of the film delivering carriage (14) in order to control the moving of step (c) in respect to a predetermined sequence of wrapping;

f) stopping step (c) at the end of the predetermined sequence of wrapping;

g) moving vertically a film tail treatment device (102);

h) during step (g) detecting the height of the film tail treatment device (102);

i) stopping step (g) when step (h) detects that the film tail treatment device (102) is at a desired height with respect to a film portion extending between the roll of film (60) and the article;

j) after step (f), moving vertically the clamping mechanism;

k) during step (j) detecting the height of the clamping mechanism;

l) stopping step (j) when step (k) detects that the clamping mechanism is at a desired height with respect to said film portion;

m) after step (l), clamping said film portion with the clamping mechanism; and n) after step (m), cutting said film portion with cutting mechanism of the film tail treatment device (102).

According to a preferred embodiment of the invention, the method comprises a further step of (o) after step (n), wiping a free end of the film portion extending from the article (40) against the article (40) with wiping mechanism of the film tail treatment device (102).

Still according to a preferred embodiment of the invention, the film tail treatment device (102) is mounted on the film delivering carriage (14). As a result, the steps (c) and (g) of the method are executed in a single step, and the steps (e) and (h) are also executed in a single step. According to another preferred embodiment of the invention, the steps (g) and (j) of the method are executed in a single step.

We will now describe different operating modes of an apparatus according to the present invention. The operator selects a wrapping mode among the following modes: two ways wrap spiral up/down mode, one way wrap spiral up/spiral down mode, banding mode and split article banding mode. For example, the operator selects the two ways wrap spiral up/down mode. The cycle of this mode begins when one article (40) is brought on centre of the wrapping area. The operator manually clamps the film (60) by means of the set of jaws (23) for the first cycle. The two ways wrap cycle starts by activating the rotary arm (38) to rotate the carriage (14) around the article (40).

The carriage (14) and the film tail treatment device (102) moves up on sliders (16) mounted on the boom (13) while at the same time it turns around the article (40) as the rotary arm (38) is rotating. When the carriage (14) reaches the top, it stop with the photoeye of the optical proximity sensing mechanism (19) mounted on the same carriage (14), then makes at least one revolution and goes down. Revolutions at the top are called top wrap and are pre set by an operator. The carriage (14) makes one revolution at the lowest position to cover the set of jaws (23) with one layer of film (60). While the carriage (14) in moving, the clamping mechanism (45) stayed stationary. The rotary arm (38) stops at standby position. The set of jaws (23) opens to free the film (60). The telescopic arm (6) of the film tail treatment device (102) pushes the film (60) in the centre line of the set of jaws (23). The set of jaws (23) closes on the film (60) to secure it. The heat wire (10) is rotated to touch the film (60) to cut it. The brush (1) is brought out so it slides against the article (40). The article (40) is moved out of the centre of the conveyor (44) and the film tail treatment device (102) is brought at standby position (46). The next article is brought up simultaneously.

The one way wrap spiral mode will now be described. The cycle of this mode begins when one article (40) is brought on centre of the wrapping area on the conveyor (44). The operator manually clamps the film (60) by means of the set of jaws (23) for the first cycle. The one way wrap cycle starts by activating the rotary arm (38) to rotate the carriage (14) around the article (40). The rotary arm (38) makes one revolution at the lowest height so the film (60) passes over the set of jaws (23). The set of jaws (23) is open to free the film (60). The carriage (14) and the film tail treatment device (102) moves up on sliders (16) mounted on the boom (13) while at the same time it turns around the article (40) as the rotary arm (38) is rotating. simultaneously the set of jaws (23) which are mounted on the table (281) of the scissors lift (28) moves up to follow the carriage (14) and positions itself at the right height in view of the carriage (14). At the top, after at least one revolution, the rotary arm (38) stops at the standby position (46). The telescopic arm (6) of the film tail treatment device (102) pushes the film (60) in the centre line of the set of jaws (23). The set of jaws (23) closes on the film (60) to secure it. The heat wire (10) is rotated to touch the film (60) to cut it. The brush (1) is brought out so it slides against the article (40). The article (40) is moved out of the centre of the conveyor (44) and the film tail treatment device (102) is brought at standby position (46). The next article is brought up simultaneously. The carriage (14) and the set of jaws (23) are still at the top and ready to start another cycle from the top.

The banding mode will now be described. The operator selects the quantity of band to apply, up to three per article (40), and the height at which he wants it. One article (40) is brought on the centre of the conveyor (44). The operator manually clamps the film (60) for the fist cycle by means of the set of jaws (23) to apply the first band of film (60). The cycle starts for three bands. The carriage (14) and the film tail treatment device (102) moves on sliders (16) that are mounted on the boom (13) to place itself at the first pre set height to apply the first band of film (60). Simultaneously the set of jaws (23) moves to follow the carriage (14) and position itself at the right height in view of the carriage (14). The carriage (14) makes one revolution at that position so that the film (60) is applied over the set of jaws (23) once. The set of jaws (23) opens to free the film (60).

Once the set of jaws (23) is open, the rotary arm (38) makes the required pre set number of revolutions. When the number of revolution is completed the carriage (14) moves on sliders (16) mounted on the boom (13) while at the same time it turns around the article (40) to place itself to apply a second band of film (60). Simultaneously the set of jaws (23), which is mounted on a table (281) of the scissors lift (28) moves to follow the carriage (14) and positions itself at the right height in view of the carriage (14). Once the carriage (14) and the set of jaws (23) are at the right height, the rotary arm (38) makes the required pre set number of revolutions. When the number of revolution is completed the carriage (14) moves on sliders (16) while at the same time it turns around the article (40) to place itself to apply the third band of film (60). Simultaneously the set of jaws (23) moves to follow the carriage (14) and position itself at the right height in view of the carriage (14).

Once the carriage (14) and the set of jaws (23) are at the right height, the rotary arm (38) makes the required pre set number of revolutions. The rotary arm (38) stops at standby position (46). The telescopic arm (6) of the film tail treatment device (102) pushes the film (60) in the centre line of the set of jaws (23). The set of jaws (23) closes on the film (60) to secure it. The heat wire (10) is rotated to touch the film (60) to cut it. The brush (1) is brought out so it slides against the article (40). The article (40) is moved out of the centre of the conveyor (44) and the film tail treatment device (102) is brought at standby position (46). The next article is brought up simultaneously. As a new article is brought in position on the conveyor (44), the carriage (14) and the set of jaw (23) moves back down to start a new banding cycle.

The split articles banding mode will now be described. This mode is made to apply one band on each article (40) that are stack one on top of the other. The operator selects the height of the band to be applied on the lower article (40), by giving the length from the bottom of that load, and the quantity of band to be applied. Then, the operator selects the height of the band to be applied on the top article (40), by giving the length from the bottom of that article (40), and the quantity of band to be applied. Two articles (40), equal in length, are brought one on top of the other on the centre of the conveyor (44). The controlling mechanism calculates the article (40) height by raising the carriage (14) up until the optical proximity sensing mechanism (19) detect the top of the articles (40). The height is split in two in order to know at what height starts the top article (40). The operator manually clamps the film (60) by means of the set of jaws (23) for the first cycle. Split load cycle starts by moving the carriage (14) and the film tail treatment device (102) on sliders (16) to position itself at the pre set height for applying a band of film (60) on the top of the article (40).

Simultaneously, the set of jaws (23) moves to follow the carriage (14) and positions itself at the right height in view of the carriage (14). Once the carriage (14) is at the right height, the rotary arm (38) makes one revolution to apply a layer of film (60) over the set of jaws (23). The set of jaws (23) is open to free the film (60). Rotary arm (38) makes the required pre set number of revolutions and stops at standby position (46). This part of the cycle is terminated as explained earlier and the carriage (14) moves on sliders (16) to place itself to apply a band of film (60) around the bottom of the article (40).

Simultaneously, the set of jaws (23) moves to follow the carriage (14) and position itself at the right height in view of the carriage (14). Once the carriage (14) is at the right height, the rotary arm (38) makes one revolution so that a layer of film (60) is applied over the set of jaws (23). The set of jaws (23) is open to free the film (60). Rotary arm (38) makes the required pre set number of revolutions and stops at standby position (46). The cycle is terminated as explained earlier and the set of jaws (23) moves back down to start a new cycle.

It will be now explained some differences between the present invention and methods of the prior art. The film tail treatment and clamp devices are activated at the end of a wrapping cycle, as it is known in the art. These devices are used to cut and wipe the film at the end of a wrapping cycle. The cut and wipe device and the clamp device are separate components of the wrapping machine that are working together.

The film tail treatment device known in the art is fixed on the frame of the machine at a specific height. The clamp device is also fixed at a specific height on either a turntable or on a conveyor. Now according to the present invention, the film tail treatment device (102) is mounted on a moving carriage (film delivering carriage) and the clamp device is mounted on a scissors lift table (281). That scissors lift table (281) makes the set of jaws (23) follows the carriage up and down. Now the machine is able to wrap, then stop at any height to end and start its wrapping cycles.

The machine according to the present invention can start and end its cycle at any position along the article (40). The machine can wrap from the bottom to the top then end its cycle and take the article (40) out. Bring the next load, wrap from the top to the bottom then end its cycle again. It also can make banding which means that the carriage (14) goes to a pre-set height given by the operator, then start its wrap cycle in stationary mode (i.e. to secure together two articles (40) one on top of the other).

It is more versatile, more efficient and a lot faster with those two devices (film tail treatment device and clamping mechanism) mounted on a machine with no waste for undesired layers of film (60).

While embodiments of this invention have been illustrated in the accompanying drawings and described in detail herein above, it will be evident to those skilled in the art that changes and modifications may be made therein without departing from the essence of the invention. All such modifications or variations are believed to be within the scope of the invention as defined by the claims appended hereto.

What is claimed is:

1. A wrapping machine for wrapping an article from a roll of film, comprising:

a machine frame having a wrapping area where the article is received;

a film delivering carriage onto which the roll of film is rotatively mountable;

carriage moving means for moving the film delivering carriage vertically and horizontally around the article along a cylindrical helix path, the carriage moving means being mounted on the machine frame;

a carriage height detector for detecting the height of the film delivering carriage;

a film tail treatment device comprising cutting means for cutting the film;

device moving means for moving vertically the film tail treatment device at a desired height with respect to the article;

a device height detector for detecting the height of the film tail treatment device;

clamping means for clamping a portion of the film unrolled from the roll, in proximity of the article;

clamp moving means for moving vertically, inside the cylindrical helix path, the clamping means at a desired height with respect to the article, the clamp moving means being located so that the cylindrical helix path is not intersected by the clamp moving means when the clamp moving means moves the clamping means;

a clamp height detector for detecting the height of the clamping means; and controlling means for controlling the carriage moving means, the device moving means and the clamp moving means during the wrapping cycle with respect to the heights detected by the carriage, device and clamp height detectors so that, at the end of the wrapping cycle, the clamp means is positioned at the height required to clamp said portion of the film during operation of the film tail treatment device.

2. The wrapping machine of claim 1, wherein the film tail treatment device further comprises wiping means for wiping a free end of the film against the article at an end of a wrapping cycle.

3. The wrapping machine of claim 1, wherein the clamp moving means comprise:

a scissors lift having a mobile end movable between a standby position and an elevated position, the mobile end having a table onto which the clamping means are mounted; and an hydraulic unit for moving the mobile end of the scissors lift.

4. The wrapping machine of claim 3, wherein the hydraulic unit comprises:

a motor;

an hydraulic pump driven by the motor;

an oil tank connected to the hydraulic pump;

an hydraulic circuit connected to the hydraulic pump and to the oil tank; and a valve connected to the hydraulic circuit and comprising:

(i) an elevating command solenoid for commanding an elevation motion to the scissors lift, the elevating command solenoid having a command input signal connected to the controlling means; and (ii) a lowering command solenoid for commanding an lowering motion to the scissors lift, the lowering command solenoid having a command input signal connected to the controlling means.

5. The wrapping machine of claim 1, wherein the clamping means comprise:

a pair of jaws;

a mounting plate on which each jaw is pivotally mounted; and a pair of jaw actuators for actuating respectively the jaws, each jaw actuator interconnects the mounting plate and the corresponding jaw in order to pivot the corresponding jaw between an opened position and a closed position.

6. The wrapping machine of claim 3, wherein:

the clamping means comprise a pair of jaws;

a mounting plate on which each jaw is pivotally mounted, the mounting plate being fixed onto the table of the scissors lift; and a pair of jaw actuators for actuating respectively the jaws, each jaw actuator interconnects the mounting plate and the corresponding jaw in order to pivot the corresponding jaw between an opened position and a closed position.

7. The wrapping machine of claim 3, wherein the clamp height detector comprises:

a roll strip having a portion moving in relation to a displacement of the mobile end of the scissors lift, the strip being provided with regularly spaced apart holes; and emitting/receiving optical means for emitting light toward said portion of the strip, and for receiving light reflection therefrom to count passing holes of the strip, the emitting/receiving optical means having a signal output connected to the controlling means.

8. The wrapping machine of claim 1, wherein:

the film tail treatment device is mounted on the film delivering carriage;

the device moving means is provided by the carriage moving means; and the device height detector is provided by the carriage height detector.

9. The wrapping machine of claim 8, wherein the film tail treatment device further comprises:

a device mounting bracket mounted on the film delivering carriage;

a telescopic arm having a first end, a portion pivotally mounted on the mounting bracket and a second end;

a pivot bearing for pivotally mounting the cutting means on the second end of the telescopic arm; and a device actuator interconnecting the device mounting bracket and the first end of the telescopic arm in order to pivot the telescopic arm between an operating position where, in operation, the cutting means is properly located to cut the film, and a standby position where a movement of the film delivering carriage around the article to wrap said article is allowed.

10. The wrapping machine of claim 9, wherein the cutting means comprise:

a support mounted on the pivot bearing;

an elongated insulator mounted on the support;

a vertical heat wire mounted on the support in parallel the insulator; and rotating means for rotating the support about the pivot bearing.

11. The wrapping machine of claim 9, wherein the film tail treatment device further comprises wiping means for wiping a free end of the film against the article at an end of a wrapping cycle, the wiping means comprise:

a brush;

a brush arm having a first end pivotally mounted on the second end of the telescopic arm, and a part where the brush is mounted; and pivoting means for pivoting the brush arm with respect to the telescopic arm so that, in operation, the brush wipes the free end of the film against the article at the end of the wrapping cycle.

12. The wrapping machine of claim 1, wherein the carriage moving means comprise:

a vertical carriage boom along which the film delivering carriage is slidably mounted;

a horizontal rotary arm having a centre, a first end and a second end, the centre being pivotally mounted to an upper portion of the machine frame above the wrapping area, the first end of the rotary arm rigidly supporting an upper end of the carriage boom;

a counterweight boom having an upper end rigidly supported by the second end of the rotary arm;

a counterweight slidably mounted on the counterweight boom; and a cable interconnecting the counterweight and the film delivering carriage, the cable being guided by two idler sheaves mounted respectively at both ends of the rotary arm.

13. The wrapping machine of claim 12, wherein the carriage moving means comprise a carriage motor for driving the film delivering carriage along the carriage boom, the carriage motor having a command input signal connected to the controlling means.

14. The wrapping machine of claim 13, wherein the carriage height detector comprises:

a count sprocket driven by the carriage motor; and a proximity sensor mounted in proximity of the count sprocket for counting the rotation of the count sprocket, the proximity sensor having a signal output connected to the controlling means.

15. The wrapping machine of claim 1, further comprises an optical proximity means mounted on the film delivering carriage for detecting presence of the article as the film delivering carriage is moving along the vertical boom, the optical proximity detecting means having a signal output connected to the controlling means so that, in operation, said controlling means is informed of where is located a top end of the article.

16. A method for wrapping an article from a roll of film, comprising following steps:

a) placing the article within a wrapping area;

b) clamping a free end of the roll of film with clamping means nearby the article, the roll of film being rotatively mounted on a film delivering carriage;

c) moving the film delivering carriage vertically and horizontally around the article along a cylindrical helix path for wrapping said article;

d) after a predetermined period of time from the beginning of step (c), commanding the clamping means to release the free end of the roll of film;

e) during step (c), detecting the height of the film delivering carriage in order to control the moving of step (c) in respect to a predetermined sequence of wrapping;

f) stopping step (c) at the end of the predetermined sequence of wrapping;

g) moving vertically a film tail treatment device;

h) during step (g) detecting the height of the film tail treatment device;

(i) stopping step (g) when step (h) detects that the film tail treatment device is at a desired height with respect to a film portion extending between the roll of film and the article;

(j) after step (f), moving vertically with the clamp moving means the clamping means inside the cylindrical helix path so that the cylindrical helix path is not intersected by the clamp moving means when the clamp moving means moves the clamping means;

(k) during step (j) detecting the height of the clamping means;

(l) stopping step (j) when step (k) detects that the clamping means is at a desired height with respect to said film portion;

(m) after step (l), clamping said film portion with the clamping means; and (n) after step (m), cutting said film portion with cutting means of the film tail treatment device.

17. The method of claim 16, comprising a further step of:

o) after step (n), wiping a free end of the film portion extending from the article against the article with wiping means of the film tail treatment device.

18. The method of claim 16, wherein;

the film tail treatment device is mounted on the film delivering carriage;

the steps (c) and (g) are executed in a single step; and the steps (e) and (h) are executed in a single step.

19. The method of claim 16, wherein the steps (g) and (j) are executed in a single step.

* * * * *